US009310823B2

(12) United States Patent
Pu et al.

(10) Patent No.: US 9,310,823 B2
(45) Date of Patent: Apr. 12, 2016

(54) VOLTAGE REFERENCE

(71) Applicant: Texas Instruments Incorporated, Dallas, TX (US)

(72) Inventors: Xiao Pu, Plano, TX (US); Krishnaswamy Nagaraj, Plano, TX (US); Yue Hu, Corvallis, OR (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 82 days.

(21) Appl. No.: 14/263,136

(22) Filed: Apr. 28, 2014

(65) Prior Publication Data

US 2015/0309525 A1 Oct. 29, 2015

(51) Int. Cl.

| | |
|---|---|
| ***G05F 1/10*** | (2006.01) |
| ***G05F 3/22*** | (2006.01) |
| ***G05F 3/30*** | (2006.01) |

(52) U.S. Cl.
CPC . *G05F 3/222* (2013.01); *G05F 3/30* (2013.01)

(58) Field of Classification Search
CPC ..... G05F 3/222
See application file for complete search history.

(56) References Cited

U.S. PATENT DOCUMENTS

2007/0164809 A1* 7/2007 Fukuda ..... G05F 3/30 327/539

* cited by examiner

*Primary Examiner* — Daniel Puentes
(74) *Attorney, Agent, or Firm* — John R. Pessetto; Frank D. Cimino

(57) ABSTRACT

A voltage reference circuit includes a bipolar transistor and a circuit configured to measure the ratio of emitter current to base current of the bipolar transistor. The output voltage of the voltage reference circuit is compensated as a function of the measured ratio.

8 Claims, 3 Drawing Sheets

FIG. 3A
FIG. 3B
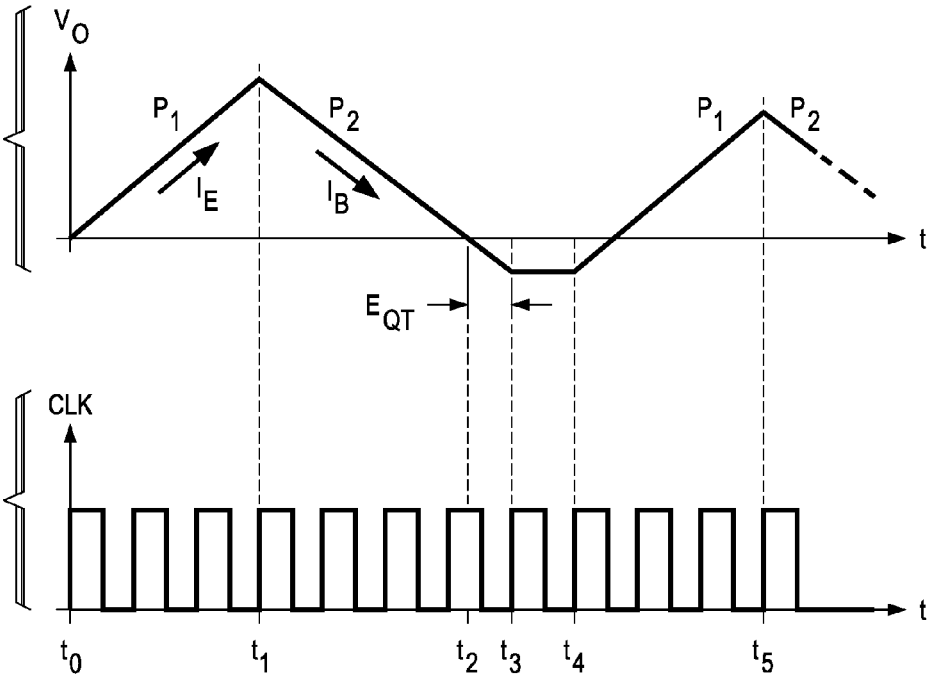
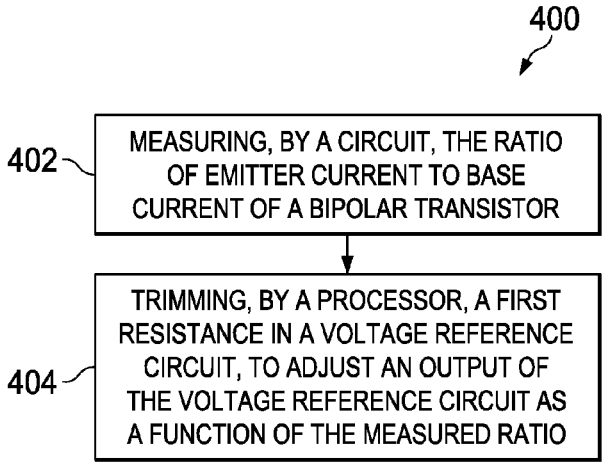
FIG. 4

VOLTAGE REFERENCE

BACKGROUND

In many electronic systems there is a need for a precision analog voltage reference that is independent of time, temperature, and process variations. For example, analog-to-digital converters typically require an analog voltage reference. In many voltage reference circuits, a first voltage source that has a positive temperature coefficient (voltage increases with temperature) is summed with a second voltage source that has a negative temperature coefficient and the two temperature dependencies cancel. For example, in one common design (called a bandgap reference, or sometimes a Browkaw bandgap reference) the base-to-emitter voltage of a bipolar-junction-transistor is used for a first voltage having a negative temperature coefficient, and the difference between two base-to-emitter voltages is used for a second voltage having a positive temperature coefficient, and the two voltages are scaled and summed. After adjustment, such a circuit can typically provide a voltage reference having about one percent voltage variation over a specified temperature range. However, some systems need a voltage reference having better than one percent accuracy over a specified temperature range. There is an ongoing need for a higher precision voltage reference.

BRIEF DESCRIPTION OF THE DRAWINGS

FIGS. 3A and 3B are timing diagrams illustrating some example voltage waveforms in the circuit illustrated in FIG. 2.

FIG. 4 is a flow chart illustrating an example method of compensating a voltage reference circuit.

DETAILED DESCRIPTION

Figure 1:
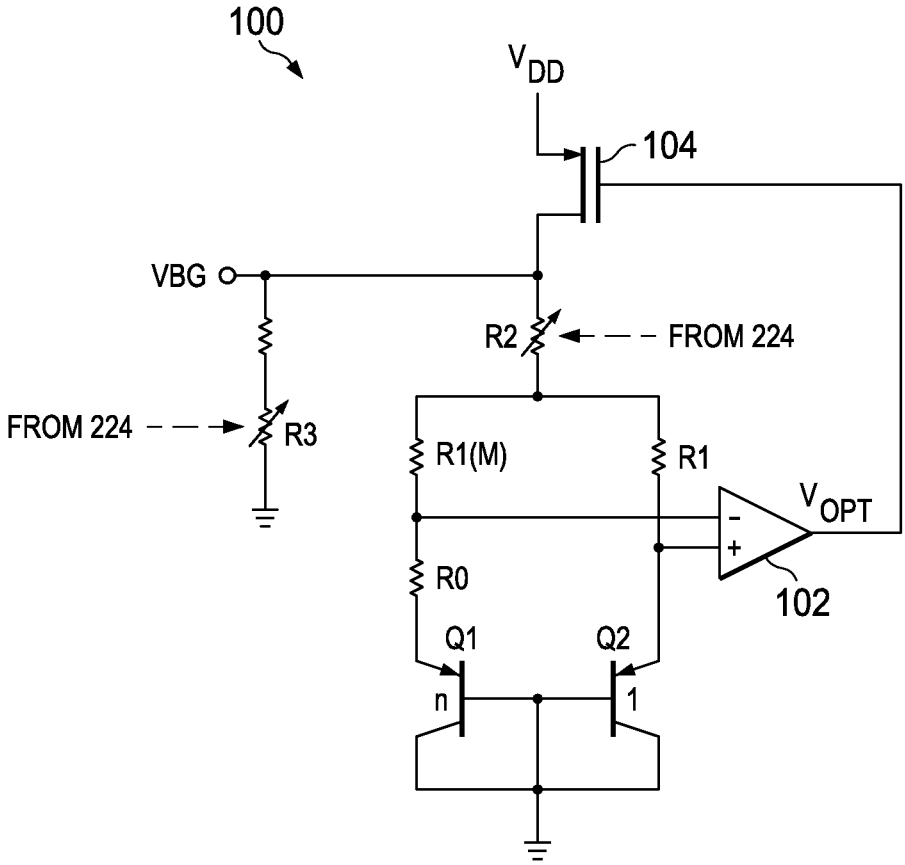
FIG. 1 is a block diagram schematic of an example embodiment of a voltage reference circuit.

FIG. 1 illustrates the core portion of one embodiment of one example of a voltage reference circuit 100. The circuit 100 produces an output voltage VBG that may be used as a voltage reference by other circuitry. In the example of FIG. 1 two bipolar-junction-transistors (Q1, Q2) have the same base voltages. The size (area) of the emitter of transistor Q1 is "n" times the size of the emitter of transistor Q2. There is a resistor R1 in the emitter path of transistor Q2. There is a resistor R1(m) in the emitter path of transistor Q1 having a resistance of "m" times the resistance of resistance R1. In a specific example embodiment, n=8 and m=3. An operational amplifier 102 with negative feedback drives the voltage between the two inputs to the amplifier 102 to be zero, so the voltages across R1 and R1(m) are equal. As a result, the emitter current for transistor Q2 is "m" times the emitter current for transistor Q1. As a result of the different sizes for Q1 and Q2, the current density (current/area) for transistor Q2 is m*n times the current density for transistor Q1. The base-to-emitter voltage of transistor Q2 has a negative temperature coefficient. The difference between the base-to-emitter voltages of transistors Q2 and Q1, established across resistor R0, has a positive temperature coefficient. The output voltage VBG is a scaled sum of the base-to-emitter voltage difference of transistors Q2 and Q1 and the base-to-emitter voltage of transistor Q2.

$$VBG = V_{BE} + \Delta V_{BE}\frac{mR_1 + (1+m)R_2}{R_0} = V_{BE} + M * \Delta V_{BE} \quad \text{Equation 1}$$

$$\text{where } M = \frac{mR_1 + (1+m)R_2}{R_0}$$

As illustrated in FIG. 1, resistors R2 and R3 are variable. The slope of $V_{BE}$ (rate of change in $V_{BE}$ with temperature) varies strongly with the integrated circuit process. This process dependency is trimmed at manufacturing time by trimming resistor R2 to adjust M. Resistor R3 is trimmed at manufacturing time to adjust for the magnitude error of VBG. Ideally, the resulting output voltage VBG is the bandgap voltage for a bipolar junction transistor at room temperature (approximately 1.22V). Ideally, the resulting output voltage VBG is independent of temperature. In practice, without further modification to the circuit of FIG. 1, VGB may vary by tens of millivolts over the temperature range of interest (230 degrees Kelvin to 400 degrees Kelvin).

Note that R2 and R3 may be implemented, for example, as groups of parallel resistors with fuses that may be blown at manufacturing time to remove some parallel resistors, and with switches that may be controlled by a processor in real time to determine how many parallel resistors are connected. Accordingly, fuses may be blown to provide coarse initial resistance values, and switches may be used to provide fine adjustment.

The difference between the base-to-emitter voltages is as follows:

$$\Delta V_{BE} = \frac{kT}{q}\ln\left(\frac{i_{C2}}{i_{C1}}\right) \quad \text{Equation 2}$$

Where k is the Boltzmann constant ($1.38\times10^{-23}$ J/K), T is the absolute temperature in Kelvins, q is the electric charge on an electron ($1.6\times10^{-19}$ C), and $i_{C1}$ and $i_{C2}$ are the collector currents of transistors Q1 and Q2, respectively.

Accordingly, the difference between the two base-to-emitter voltages is proportional to absolute temperature (PTAT), with a slope proportional to the log of the ratio of the collector currents. Typically, for bandgap voltage reference circuits, NPN bipolar transistors are used and the collector terminals are accessible for measuring collector current. However, a problem with modern short channel CMOS processes is that the only bipolar transistors that can be implemented are substrate PNP transistors whose collector terminals are not accessible. To overcome this problem, in the embodiment illustrated in FIG. 1, amplifier 102 measures a differential result of two emitter currents. The difference between the two base-to-emitter voltages, using the emitter currents, is as follows:

$$\Delta V_{BE} = \frac{kT}{q}\ln\left(\frac{i_{E2}\left(\frac{\beta_2}{\beta_2+1}\right)}{i_{E1}\left(\frac{\beta_1}{\beta_2+1}\right)}\right) = \frac{kT}{q}\ln\left(mn\frac{\beta_2(\beta_1+1)}{\beta_1(\beta_2+1)}\right) = \frac{kT}{q}\ln(mn) + \frac{kT}{q}\ln\left(\frac{\beta_2(\beta_1+1)}{\beta_1(\beta_2+1)}\right) \quad \text{Equation 3}$$

Where $i_{E1}$ is the emitter current of transistor Q1, $i_{E2}$ is the emitter current of transistor Q2, $\beta_1$ is the ratio of collector current to base current of transistor Q1, and $\beta_2$ is the ratio of collector current to base current of transistor Q2.

Equation 3 may be simplified by using the following definitions:

$$\text{Let } \Delta V_{BE(ideal)} = \frac{kT}{q}\ln(mn) \quad \text{Equation 4}$$

$$\text{Let } V_\beta = \frac{kT}{q}\ln\left(\frac{\beta_2(\beta_1+1)}{\beta_1(\beta_2+1)}\right) \quad \text{Equation 5}$$

The result is a simplified equation 6 as follows:

$$\Delta V_{BE}=\Delta V_{BE(ideal)}+V_\beta \quad \text{Equation 6}$$

In some semiconductor integrated circuit processes optimized for fabricating bipolar transistors, $\beta_1$ and $\beta_2$ may be large (>100) so that $V_\beta$ is negligible and from equation 6, $\Delta V_{BE}=\Delta V_{BE(ideal)}$. However, for some semiconductor integrated circuit processes optimized for fabricating metal oxide semiconductor (MOS) transistors, $\beta_1$ and $\beta_2$ may be relatively small (<10), so that $V_\beta$ becomes relatively significant. If $\beta_1$ and $\beta_2$ are small, then $V_\beta$ causes two inaccuracies as follows. First, with small $\beta_1$ and $\beta_2$ the process error is not sufficiently trimmed out. That is, when a fabrication process results in small $\beta_1$ and $\beta_2$, then from equation 6, $\Delta V_{BE}$ is not equal to $\Delta V_{BE(ideal)}$ even at the initial manufacturing-time calibration at room temperature. Second, $\beta_1$ and $\beta_2$ vary with temperature. With the different current densities for transistors Q1 and Q2, $\beta_1$ and $\beta_2$ vary with temperature with unequal curvature. Accordingly, $V_\beta$ causes an offset during the initial manufacturing calibration at room temperature and $V_\beta$ causes a nonlinear variation in $\Delta V_{BE}$ over the temperature range of interest. In the example embodiment discussed below, $\beta_1$ and $\beta_2$ are measured at the operating temperature (both at manufacturing time and in real time), $V_\beta$ is calculated, and resistors R2 and R3 are trimmed to compensate for $V_\beta$. This computed compensation for $V_\beta$ enables a voltage reference with about 0.2% variation over a temperature range of interest.

The ideal VBG ($VBG_{ideal}$) is as follows:

$$VBG_{ideal}=V_{BE}+M^*(\Delta V_{BE(ideal)}) \quad \text{Equation 7}$$

Combining equation 1 and equation 6, the actual VBG ($VBG_{actual}$) without compensation is:

$$VBG_{actual}=V_{BE}+M^*(\Delta V_{BE(ideal)}+V_\beta) \quad \text{Equation 8}$$

$VBG_{ideal}$ is known for a given manufacturing process. At manufacturing time $VBG_{actual}$ may be adjusted to equal $VBG_{ideal}$ at room temperature. However, $VBG_{actual}$ as a function of temperature has a curvature that is a function of M. If M is adjusted (by adjusting R2) to the value required in equation 7, then $VBG_{actual}$ will have the minimum variation over temperature. However, if M is adjusted at manufacturing time without compensating for $V_\beta$ (equation 8), then M will not have the value required in equation 7, and M will not have the value required for minimal variation of $VBG_{actual}$ over temperature. To overcome this, R2 is trimmed in two steps. First, R2 is trimmed until $VBG_{actual}=VBG_{ideal}$. Denoting the resulting initial value of M as $M_0$, R2 is further trimmed until $VBG_{actual}=VBG_{ideal}+M_0*V_\beta$. The resulting value of M preserves the curvature of $VBG_{actual}$ over temperature, which is already minimized over temperature by design. However, note that after this step, $VBG_{actual}$ is offset from $VBG_{ideal}$ by $M_0*V_\beta$. Then, R3 is trimmed to adjust $VBG_{actual}$ back to $VBG_{ideal}$.

Figure 2:
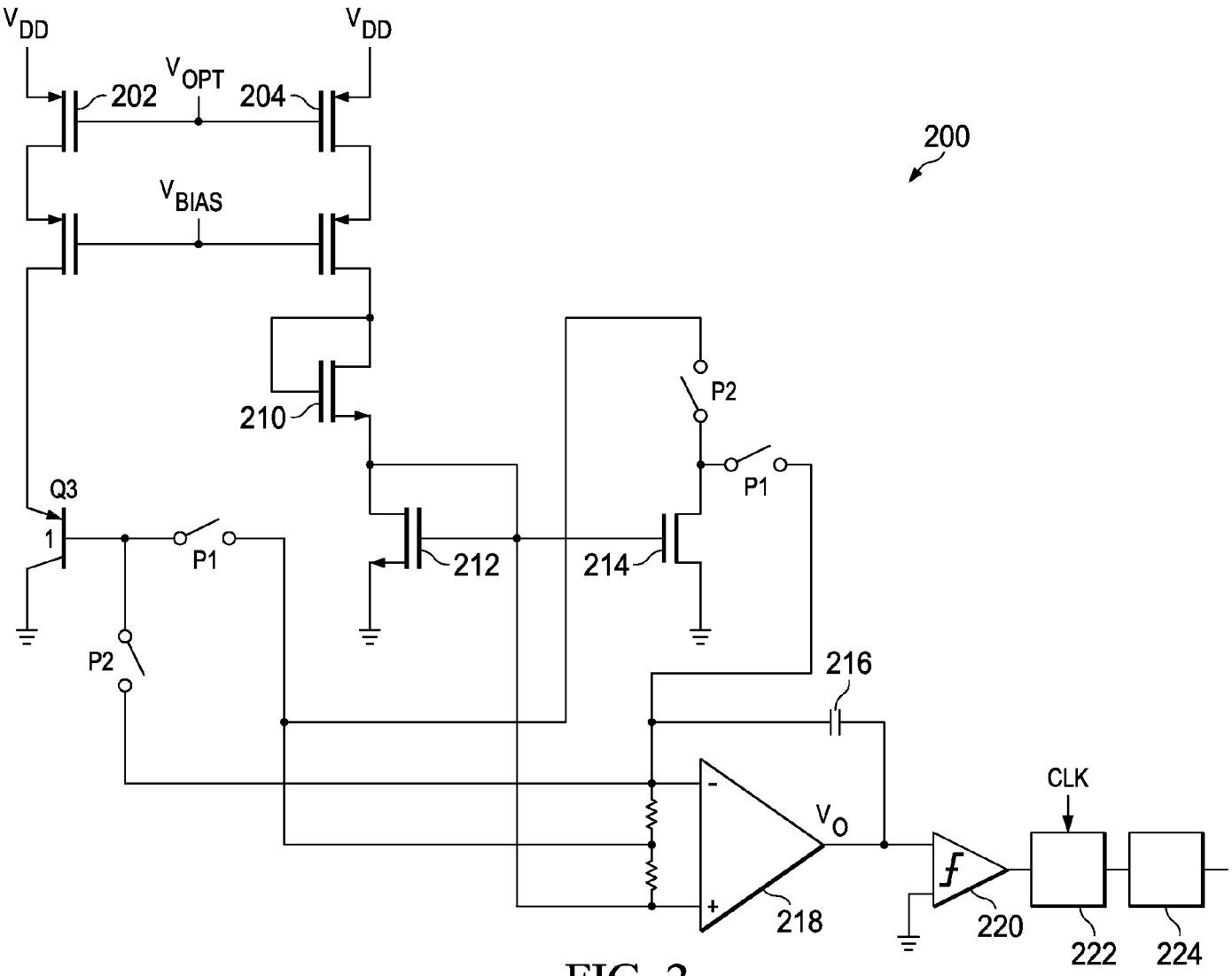
FIG. 2 is a block diagram schematic of an example embodiment of a circuit for measuring beta of a bipolar junction transistor.

In order to adjust M with compensation for $V_\beta$, $V_\beta$ needs to be determined. FIG. 2 illustrates an example embodiment of a circuit for measuring $\beta_1$ and $\beta_2$. In FIG. 2, a third bipolar transistor Q3 is used for beta measurement. As discussed in more detail below, the current density of transistor Q3 in FIG. 2 can be set to a desired value by properly adjusting its emitter current. The current density of transistor Q3 (FIG. 2) may be forced to equal the current density of transistor Q2 (FIG. 1), and the ratio of the resulting emitter current to base current may be measured. Alternatively, the current density of transistor Q3 (FIG. 2) may be forced to equal the current density of transistor Q1 (FIG. 1), and the ratio of emitter current to base current may be measured. The ratio of emitter current to base current is equal to $\beta+1$. Accordingly, $\beta_1$ and $\beta_2$ are measured in real time.

In FIG. 1, transistor Q1 receives a current of i1, and transistor Q2 receives a current of m*i1. The relative current density in transistor Q1 is i1/n and the relative current density in transistor Q2 is i1*m/n. The total current in transistor 104 is the total of the emitter currents of transistors Q1 and Q2, which is (1+m)i1. In FIG. 2, $V_{opt}$ is the output of the operational amplifier 102 in FIG. 1. In FIG. 2, translator 202 is a current source and the current in transistor Q3 is the same as the current through transistor 202. The current in transistor 202 in FIG. 2 (and therefore the emitter current in transistor Q3 in FIG. 2) is proportional to the ratio of the size of transistor 202 (FIG. 2) to the size of transistor 104 (FIG. 1). For example, if transistor 104 (FIG. 1) is one unit in size, and if transistor 202 (FIG. 2) is two units in size, then the current in transistor 202 (FIG. 2) will be twice the current in transistor 104 (FIG. 1). Although transistors 202 and 204 in FIG. 2 are depicted as individual transistors, each transistor may be implemented as a group of parallel transistors, and the effective "size" may be adjusted by controlling switches to determine the number of transistors operating in parallel. Accordingly, the current density of transistor Q3 (FIG. 2) can be switched to equal the current density of transistor Q1 (FIG. 1) (or the current density of transistor Q2 in FIG. 1) by switching the size of transistor 202 (FIG. 2). Assuming, for example, that the size of the emitter of transistor Q2 (FIG. 1) is one unit, and the emitter of transistor Q3 (FIG. 2) is the same size as transistor Q2 (FIG. 1), and that transistors 104 (FIG. 1) and 202 (FIG. 2) are the same size, then the current density in transistor Q3 is (1+m)i1. If transistor 202 (FIG. 2) is scaled to be 1/(n(1+m)) times the area of transistor 104 (FIG. 1), then the current density of transistor Q3 (FIG. 2) is the same as the current density of transistor Q1 (FIG. 1). If transistor 202 (FIG. 2) is scaled to be m/(n(1+m)) times the area of transistor 104 (FIG. 1), then the current density of transistor Q3 (FIG. 2) is the same as the current density of transistor Q2 (FIG. 1).

In FIG. 2, transistors 202 and 204 are switched to be the same size, and they serve as current sources. As discussed above, their currents are determined by the current through transistor 104 in FIG. 1 and their size relative to the size of transistor 104. In FIG. 2, transistor 212 has the same current as transistor 204. Transistors 212 and 214 form a current mirror (transistor 214 has the same current as transistor 212). When the circuit 200 is measuring the emitter current of transistor Q3, the current through the emitter of transistor Q3 is mirrored by the current through transistor 214 (via transistors 204 and 212) so that it is actually the current through transistor 214 that is being measured. Transistor 210 is a voltage level shifter that helps to ensure that transistors 212 and 214 have similar source-drain voltages.

In FIG. 2, an integrating operational amplifier 218 is used to implement a dual-slope integrating analog-to-digital converter (ADC). The amplifier 216 integrates a first current for a predetermined fixed time period, which charges a capacitor 216. The amplifier 218 then integrates a second current, which discharges the capacitor 216 until a comparator 220 detects that the capacitor 216 is completely discharged. A clock-based timer 222 measures the time required for the second current to discharge the capacitor 216. The ratio of the charge time to the discharge time is proportional to the ratio of the currents. Accordingly, when the first current is an emitter current, and the second current is a base current, then the integrating ADC provides a digital measurement of β+1 (the ratio of emitter current to base current).

In FIG. 2, when switches p1 are closed, current through transistor 214, which is equal to the emitter current of transistor Q3, is drawn from the negative terminal of the Integrating operational amplifier 218, resulting in a positive ramp at the output of the integrating operational amplifier 210. When switches p2 are closed, the base current of transistor Q3 drives the negative terminal of the integrating operational amplifier 218, resulting in a negative ramp at the output of the integrating operational amplifier 218. The integrating ADC is used to measure β+1 for a current density of one of Q1 or Q2 of FIG. 1, and then is used to measure β+1 for the current density of the other of Q1 or Q2 of FIG. 1. Given the measurements of β+1, a processor 224 is used to compute $\beta_1$, $\beta_2$, and $V_\beta$. $\beta_1$ and $\beta_2$ are measured at the operating temperature (both at manufacturing time and in real time), and the processor 224 trims resistors R2 and R3 (FIG. 1) to compensate for $V_\beta$.

An integrating ADC has some inherent quantization error. This is illustrated in FIG. 3A. FIG. 3A illustrates the voltage $V_O$ at the output of amplifier 218 in FIG. 2. FIG. 3B illustrates the clock (CLK) input to the timer 222 in FIG. 2. In FIG. 3A, at time $t_0$, switches p1 (FIG. 2) are closed, capacitor 216 (FIG. 2) starts charging with emitter current, and capacitor 216 charges for a known fixed time (3 clock periods in the example of FIG. 3A). At time $t_1$, switches p1 are opened and switches p2 are closed, capacitor 216 starts discharging with base current, and the timer 222 counts clock pulses until the capacitor 216 is discharged at time $t_2$. In the example of FIG. 3A, time $t_2$ occurs during the fourth clock period after time $t_1$. The output of the digital counter in timer 222 has a value of four, but the actual value is between four and five. In FIG. 3A, the time from when the capacitor 216 discharges to zero (as detected by the comparator 220 in FIG. 2) and the start of the next clock cycle (time $t_3$) is the quantization error $E_{QT}$. The measurement process may be compensated to reduce the quantization error as discussed below.

The capacitor 216 may be discharged until time $t_3$, resulting in a negative voltage across the capacitor. The resulting negative voltage across capacitor 218 is an analog measure of the quantization error. To reduce the quantization error, the timer value may be incremented by one (to a value of five in the example of FIG. 3A) and the voltage across the capacitor 216 at time $t_3$ may be left on the capacitor 216 at the beginning of another measurement cycle measuring the same β again. For example, if $\beta_1$ is being measured, then multiple consecutive measurements of $\beta_1$ may be made, with each measurement carrying over the analog quantization error (residual voltage across capacitor 216) from the immediately preceding measurement of $\beta_1$. In FIG. 3A, at time t4, the capacitor 216 starts charging with an initial negative value, again for a fixed time period ending at time $t_5$. As a result of starting at a negative value, the voltage $V_O$ at time $t_5$ is less than the voltage $V_O$ at time $t_1$, and the capacitor 216 will take less time to discharge to zero, resulting in a smaller timer value for the measurement of base current. Then, the residual quantization error may be earned over to the next cycle and so forth. At the end of N such cycles there will still be some residual quantization error. The maximum digital value of this error is one count because the quantization error cannot exceed one clock interval Since the digital output gets multiplied by a factor of N during accumulation over N cycles, the effective quantization error is reduced by a factor of N. After measuring $\beta_1$ N times and averaging the measurements, then the capacitor 216 may be discharged to zero and N measurements may be mace for $\beta_2$.

FIG. 4 illustrates an example embodiment of a method 400 for compensating a voltage reference circuit. At step 402, a circuit measures the ratio of emitter current to base current of a bipolar transistor. At step 404, a processor trims a resistance in a voltage reference circuit to adjust an output of the voltage reference circuit as a function of the measured beta.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A voltage reference circuit having an output voltage, the circuit comprising:

a bipolar transistor having a base and an emitter;

a circuit configured to measure the ratio of emitter current to base current of the bipolar transistor;

the output voltage being compensated as a function of the measured ratio;

the bipolar transistor being a third bipolar transistor, the circuit further comprising:

first and second bipolar junction transistors having different current densities;

where the third bipolar junction transistor is driven with the same current density as one of the first and second bipolar junction transistors;

where the third bipolar transistor is alternately driven with the current density of the first bipolar transistor and the current density of the second bipolar transistor.

2. The voltage reference circuit of claim 1, where the current density in the third bipolar transistor is determined by a ratio of the size of a current source driving the first and second bipolar transistors to the size of a current source driving the third bipolar transistor.

3. The voltage reference circuit of claim 2, where the size of the current source driving the third bipolar transistor is determined by switches controlling a number of transistors being connected in parallel.

4. A voltage reference circuit having an output voltage, the circuit comprising:

a bipolar transistor having a base and an emitter;

a circuit configured to measure the ratio of emitter current to base current of the bipolar transistor;

the output voltage being compensated as a function of the measured ratio;

further comprising:

an integrating analog-to-digital converter (ADC), the integrating ADC charging a capacitance for a first time period with the emitter current of the bipolar transistor, and discharging the capacitance for a second time period with the base current of the bipolar transistor, and where the ratio of emitter current to base current of the bipolar transistor is proportional to the ratio of the first time period to the second time period.

5. The voltage reference circuit of claim 4, where the ADC includes compensation to reduce quantization error.

6. A method, comprising:

measuring, by a circuit, the ratio of emitter current to base current of a bipolar transistor; and trimming, by a processor, a first resistance in a voltage reference circuit, to adjust an output of the voltage reference circuit as a function of the measured ratio;

the step of measuring further comprising:

switching, by the circuit, emitter current in the bipolar transistor, so that the ratio of emitter current to base current is measured for a plurality of current densities.

7. The method of claim 6, the step of measuring further comprising:

measuring, by an integrating ADC, the ratio of the time required to charge a capacitance using an emitter current to the time required to discharge the capacitance using a base current.

8. The method of claim 7, further comprising:

compensating, by the ADC, for quantization error.

* * * * *